US009898906B2

(12) United States Patent
Burgess

(10) Patent No.: US 9,898,906 B2
(45) Date of Patent: Feb. 20, 2018

(54) RFID BASED EVENT SENSOR

(71) Applicant: Facebook, Inc., Menlo Park, CA (US)

(72) Inventor: Kirk Erik Burgess, Menlo Park, CA (US)

(73) Assignee: Facebook, Inc., Menlo Park, CA (US)

( * ) Notice: Subject to any disclaimer, the term of this patent is extended or adjusted under 35 U.S.C. 154(b) by 89 days.

(21) Appl. No.: 14/964,171

(22) Filed: Dec. 9, 2015

(65) Prior Publication Data

US 2017/0169675 A1 Jun. 15, 2017

(51) Int. Cl.

| | |
|---|---|
| ***G06Q 99/00*** | (2006.01) |
| ***G08B 13/08*** | (2006.01) |
| *G08B 6/00* | (2006.01) |

(52) U.S. Cl.

CPC ..... *G08B 13/08* (2013.01); *G08B 6/00* (2013.01)

(58) Field of Classification Search

None

See application file for complete search history.

(56) References Cited

U.S. PATENT DOCUMENTS

2002/0153915 A1* 10/2002 Malik ..... G01R 31/041 324/117 R
2004/0263329 A1* 12/2004 Cargonja ..... B60R 25/104 340/539.22
2007/0106527 A1* 5/2007 McKinney ..... G06Q 10/06 705/7.41
2010/0302025 A1* 12/2010 Script ..... G01P 15/09 340/539.1
2013/0321150 A1* 12/2013 Koenig ..... G08B 25/008 340/541
2014/0139342 A1* 5/2014 Brown ..... G08B 21/12 340/603
2015/0002137 A1* 1/2015 Patel ..... G01R 35/00 324/130
2016/0247370 A1* 8/2016 Lamb ..... G08B 13/08

* cited by examiner

*Primary Examiner* — Brent Swarthout
(74) *Attorney, Agent, or Firm* — Perkins Coie LLP

(57) ABSTRACT

The disclosure is directed to a sensor in which the sensing capability is made possible without need for having an independent power source of the sensor. The sensor can include a standard RFID tag, a reed switch, and an antenna. The reed switch can be closed (or opened, as appropriate) when exposed to a magnetic field. The magnetic field can be provided in various ways, e.g., an electromagnet, a permanent magnet, or an electromagnetic field (e.g., inductors wrapped around a power cord). When the reed switch is closed or opened (upon exposure to the magnetic field), the RFID tag's antenna can respond (or fail to respond, as appropriate) to a transmission signal it receives from a base station by sending a "heartbeat" signal that enables sensing in a variety of IoT applications. The sensor can be used for detecting an opening or a closing of a window.

16 Claims, 12 Drawing Sheets

RFID BASED EVENT SENSOR

BACKGROUND

A sensor is an object whose purpose is to detect events or changes in its environment, and then provide a corresponding output. A sensor can be a type of a transducer and may provide various types of output, but typically uses electrical or optical signals. Sensors are used in everyday objects such as touch-sensitive elevator buttons (tactile sensor) and lamps which dim or brighten by touching the base, etc. Most presently used sensors need a power source, e.g., a battery or power supply from an electrical outlet, to perform their functions.

A radio-frequency identification (RFID) system can be used to track various types of events using one or more wireless means. RFID is the wireless use of electromagnetic fields to transfer data, for the purposes of automatically identifying and tracking tags attached to objects. The tags contain electronically stored information. Some tags are powered by electromagnetic induction from magnetic fields produced near an RFID reader. Some types of RFID systems have a local power, source such as a battery, and may operate at hundreds of meters from the reader. Other types of tags are passive, e.g., collect energy from the interrogating radio waves and use them to transmit signals. RFID tags are used in many industries. For example, an RFID tag attached to an automobile during production can be used to track its progress through the assembly line; RFID-tagged pharmaceuticals can be tracked through warehouses; implanting RFID microchips in livestock and pets allows positive identification of animals; implanting RFID tags in clothing or other products allow them to be tracked in shopping malls: etc.

Regardless of whether RFID tags are passive or active, the RFID tags described above are typically used for just reading data. They may not be used as sensors to detect events. The RFID tags cannot be turned off or on, e.g., based on the events happening in the environment they are used, to detect the events.

DETAILED DESCRIPTION

Figure 1:
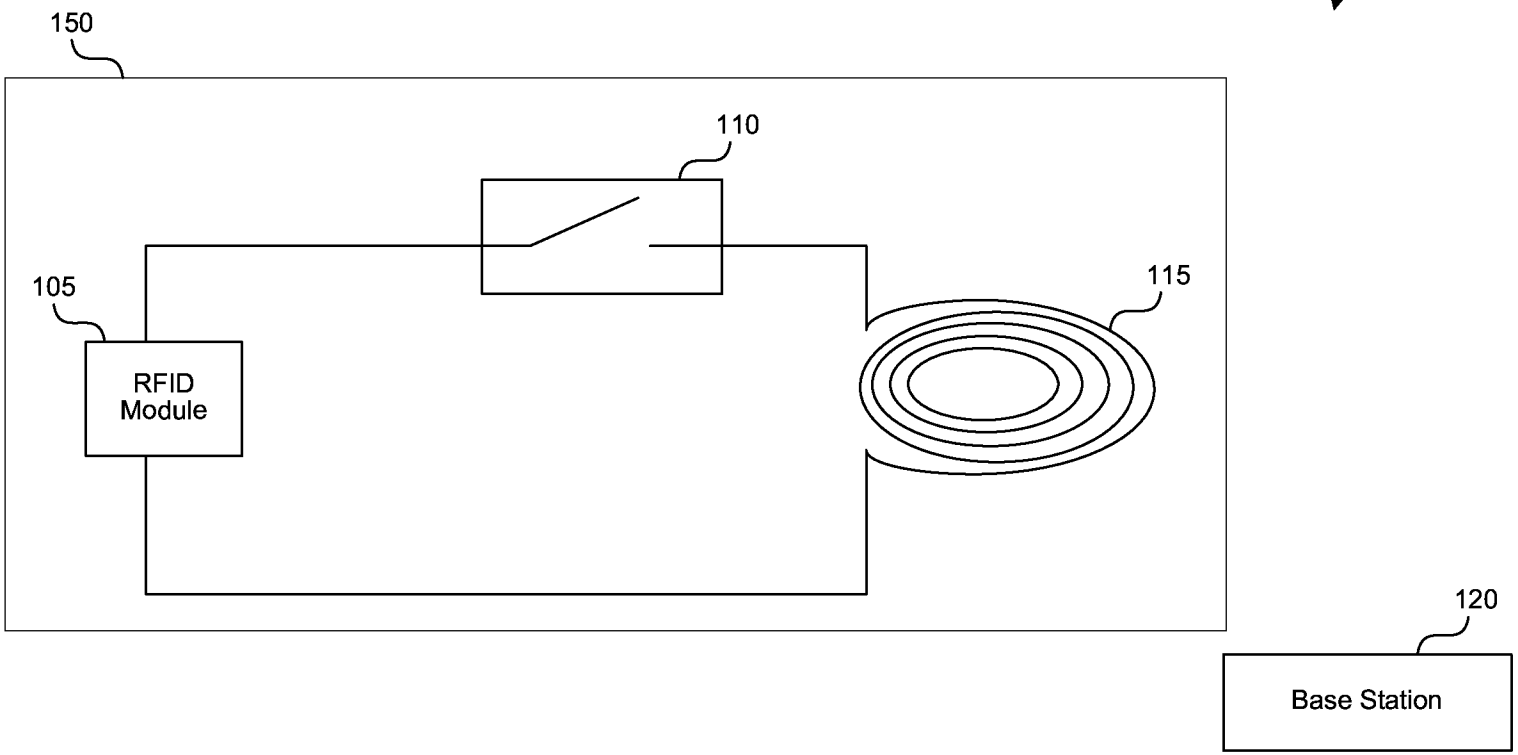
FIG. 1 is a block diagram illustrating a sensor system for sensing events in an environment in which the sensory system is used.

Embodiments are disclosed for a radio frequency (RF) based sensor ("sensor") that generates an alert on an occurrence of an event. In some embodiments, the sensor tracks the occurrence of an event using a magnetic field. Such a sensor can be built using a radio frequency identification (RFID) module that generates a RF signal, a sensing switch, e.g., a reed switch, that is actuated by a magnetic field, and an antenna that can transmit and/or receive RF signals. In some embodiments, the sensor can be built using a standard RFID tag, e.g., by adding a reed switch to the standard RFID tag or its circuit. The sensing switch can change state when exposed to a magnetic field. In some embodiments, the sensing switch switches from a first state to a second state when exposed to the magnetic field, and switches back to the first state when the magnetic field ceases to exist in the proximity of the sensing switch. For example, the sensing switch switches from an open state to a closed state when exposed to the magnetic field, and switches back to the open state when the magnetic field ceases to exist in the proximity of the sensing switch.

When the sensing switch is in a closed state, a circuit of the sensor is complete, and an antenna in the sensor can transmit and/or receive, e.g., send a response to a request from a base station, e.g., an RFID reader. In some embodiments, the response from the sensor operates as a "heartbeat" signal that enables tracking of an event by the base station. In some embodiments, the sensor transmits the heartbeat signal as an RF signal. The base station can perform one or more functions, e.g., generate alerts indicating an occurrence of an event, based on a receipt or non-receipt of the heartbeat signal.

The sensor can be used with the base station as a sensor system for tracking events in a variety of applications, e.g., Internet of Things (IoT) applications, security applications, power identification systems. For example, the sensor system can be used to determine whether a window of a building is open and generate an alert if the window is open. In some embodiments, a magnetic source, e.g., a permanent magnet, is installed on a window and the sensor is installed on a window sill. A RFID reader that polls the sensor for the heartbeat signal can be installed in any suitable location, e.g., a location at which the RFID reader can receive the heartbeat signal from the sensor via radio transmissions. When the window is closed, the window is in the proximity of the window sill and a magnetic field generated by the magnetic source in the window causes the sensing switch to be in closed state, thereby enabling the sensor to respond to the polling request from the RFID reader by sending the heartbeat signal. When the window is opened, the magnetic source installed on the window moves out of the proximity of the sensor installed on the window sill causing the sensing switch to switch to the open state and therefore, disabling the sensor from sending the heartbeat signal to the RFID reader. On not receiving the heartbeat signal from the sensor, e.g., for a specified duration, the RFID reader can then perform one or more functions such as generate an alert, e.g., send a notification to a recipient via email or a text message, generate a message in an application, trigger an audio alarm, place a telephone call to one or more recipients. Note that the above example is described using a normally open switch. However, the same can be implemented using a normally closed switch with appropriate modifications.

The sensing switch can be actuated in a number of ways. In some embodiments, the sensing switch is actuated using an external magnetic field from an electromagnet and/or a permanent magnet. In some embodiments, the sensing switch is actuated using an electromagnetic coil wound around the sensing switch. For example, a set of inductors connected in series and to a sensor can be printed onto a sticker and wrapped around a power chord of an electrical device. When the sticker is wrapped around the power cord, the set of inductors form a coil around the sensing switch of the sensor. When electrical power, e.g., an alternating current (AC), flows through the power cord, the electrical power generates a time varying magnetic field around the power cord, which generates a voltage in the set of inductors, which in turn can generate a magnetic field around the sensing switch that is strong enough to actuate the sensing switch. Such a sensor can be used in a power identification system to determine whether a particular electrical device is powered on.

The sensor can be built in various form factors. In one example, the form factor of the sensor (e.g., the RFID tag, sensing switch, and the antenna) is a sticker that can be affixed to a variety of surfaces, equipment, etc. In another example, the sensor can be installed in a housing, which can then be installed on various surfaces with appropriate mounting hardware. The sensing switch can be of an open type (i.e., normally open switch) or a close type (i.e., normally closed switch).

In some embodiments, the sensor does not have its own power source, e.g., required to generate, transmit and/or receive, radio signals. The sensor derives the necessary power from the request signal received as a RF signal from the base station.

Turning now to the figures, FIG. 1 depicts a block diagram illustrating a sensor system 100 for sensing events in an environment in which the sensory system is used. As described above, the sensor system 100 can be used to track events in various applications, e.g., IoT applications, security systems, power identification systems, robotics, toys and games. The sensor system 100 includes a sensor 150 and a base station 120, e.g., an RFID reader. The sensor 150 and the base station 120 communicate via RF signals. The sensor 150 can transmit an RF signal to the base station 120, which operates as a "heartbeat" to be used by the base station 120 to track an occurrence of an event in an environment in which the sensor system 100 is used. The base station 120 can perform one or more functions, e.g., generate an alert, based on the receipt or non-receipt of the heartbeat signal.

The sensor 150 can include an RFID module 105, a sensing switch 110 and an antenna 115. The RFID module 105 can store and process sensor data. For example, the RFID module 105 can store information associated with an environment, e.g., an object, with which the sensor 150 is used and/or information necessary to generate the heartbeat signal. The sensor data may include a unique serial number of the sensor 150, a product-related information such as a stock number, a lot or batch number, a production date associated with the object. Using the serial numbers, the base station 120 can discriminate among several sensors 150 that might be within the range of the base station 120 and read them sequentially or simultaneously. The base station 120 can transmit an encoded radio signal ("probe signal") to probe the sensor 150. The sensor 150 receives the probe signal and then responds with its identification and other information, e.g., as a heartbeat signal, to the base station 120. The sensor data can be stored in a non-volatile memory. The RFID module 105 can include either a fixed or a programmable logic for processing the transmission data and sensor data, respectively. The RFID module 105 can include a memory, e.g., erasable programmable read-only memory (EPROM), to store the sensor data.

The RFID module 105 can modulate and/or demodulate the RF signal received from and/or transmitted to the base station 120. In some embodiments, the sensor 150 is a passive RFID sensor, e.g., does not have its own power source. The RFID module 105 can create power, e.g., direct current (DC) power, from the probe signal it received from the base station 120 and use the power for performing the necessary functions, e.g., generating the heartbeat signal and powering the antenna 115 to transmit radio signals.

The antenna 115 can receive and/or transmit radio signals from and/or to the base station 120. In some embodiments, the antenna 115 can be configured as a loop. The design of the antenna 115, e.g., its length, shape, sensitivity, can be determined as a function of one or more of frequency of the RF signals with which the base station 120 and the sensor 150 communicate, and/or an expected communication range between the base station 120 and the sensor 150.

The sensing switch 110 facilitates enabling or disabling of transmission of the heartbeat signal to the base station 120. In some embodiments, the sensing switch 110 is a reed switch. The sensing switch 110 can be an electrical switch operated by a magnetic field. The contacts of the sensing switch 110 may be normally open (e.g., open state), closing when a magnetic field is applied (e.g., closed state), or normally closed and opening when a magnetic field is applied. In the embodiment of FIG. 1, the sensing switch 110 is a normally open switch. The sensing switch 110 may be actuated by a magnetic field in the proximity of the sensing switch 110. Once the magnet field ceases to exist in the proximity of the sensing switch 110 with enough force to open or close the sensing switch 110, the sensing switch 110 will return to its original state.

In some embodiments, the sensor 150 can be built using a standard RFID tag, e.g., by adding a reed switch to the standard RFID tag. The sensor 150 can be built in various form factors, e.g., depending on its intended application. For example, the sensor 150 can built as a sticker having the necessary circuitry for the sensor 150 to be placed onto an object that is being tracked. In another example, the sensor 150 can be installed in a housing that can be placed, fixed, and/or installed in association with an object that is being monitored.

The specification, e.g., mechanical and/or electrical specification, of the sensing switch 110 to be used in the sensor 150 depends on various factors, e.g., the application in which the sensor 150 is used, a strength of the magnetic field to be applied to actuate the sensing switch 110, a sensing distance, which is the maximum distance between the magnet and the sensing switch 110 at which the sensing switch 110 functions satisfactorily. The sensing switch 110 can be of a compact size, low weight, have a quick response time, a long life and of low cost.

Figure 2:
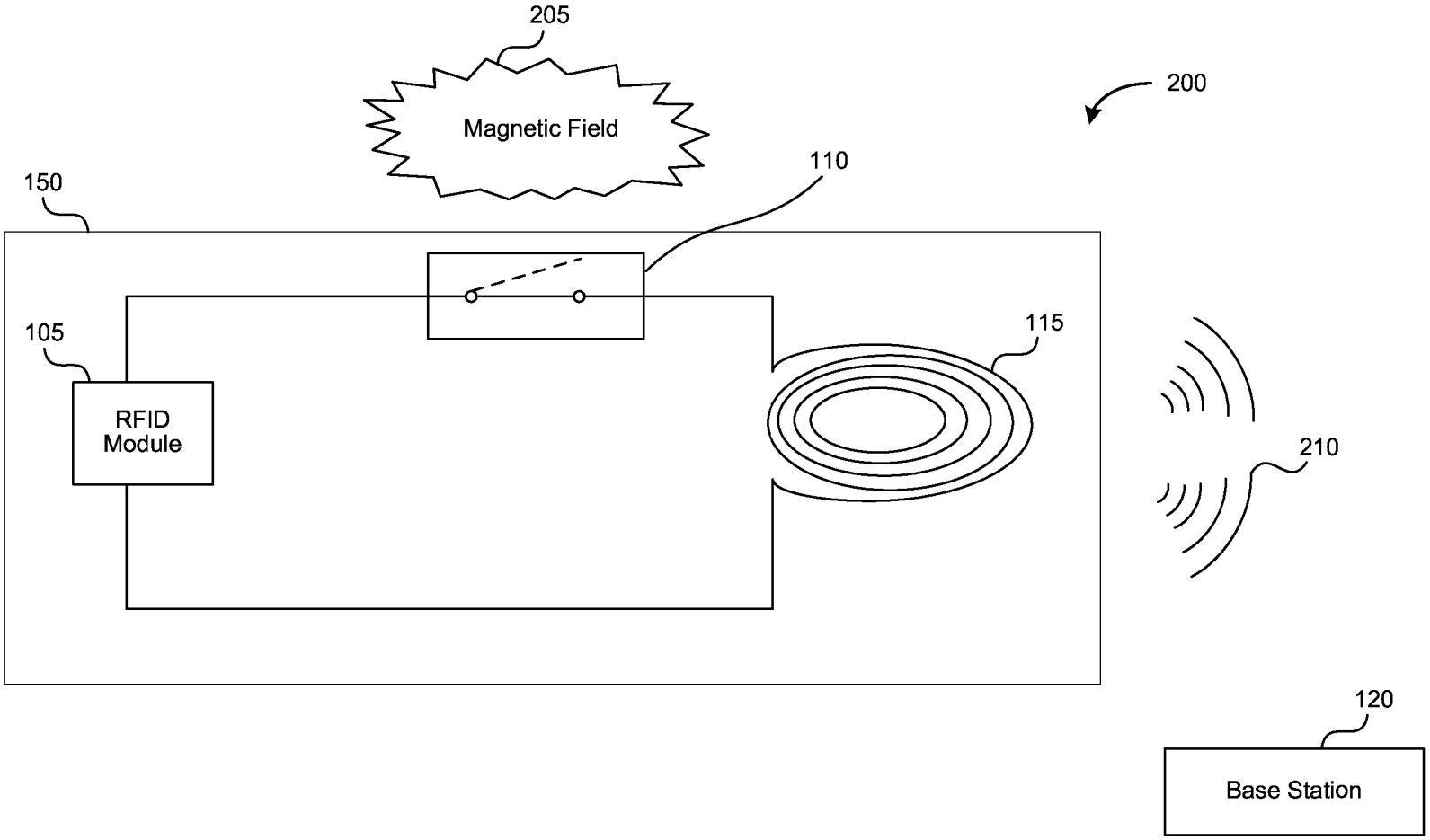
FIG. 2 is a block diagram illustrating actuating a sensing switch of a sensor of FIG. 1, consistent with various embodiments.

FIG. 2 is a block diagram illustrating actuating of the sensing switch 110 of the sensor 150 of FIG. 1, consistent with various embodiments. When a magnetic field 205 is applied to the sensing switch 110 the sensing switch 110 changes its state. As described above, in the embodiment of FIG. 1, the sensing switch 110 is a normally open switch, and therefore, when the magnetic field 205 is applied to the sensing switch 110, the sensing switch 110 switches to a closed state, as illustrated in FIG. 2. When the sensing switch 110 switches to the closed state, the circuit of the sensor 150 is completed and the sensor 150 can now transmit a heartbeat signal 210 to the base station 120, e.g., when the base station 120 sends a probe signal to the sensor 150.

When the magnetic field 205 ceases to exist or decreases in strength, the sensing switch 110 returns to an open state, e.g., as illustrated in FIG. 1, thereby causing the circuit of the sensor 150 to be incomplete and ceasing to transmit the heartbeat signal 210 to the base station 120.

In some embodiments, the sensor 150 sends the heartbeat signal 210 in response to a probing request from the base station 120 for the heartbeat signal 210. The sensor 150 may not transmit the heartbeat signal 210 unless the base station 120 requests the sensor 150 for the heartbeat signal 210. The sensor 150 can receive the probing request and/or transmit the heartbeat signal 210, e.g., in response to the probing request, only if the circuit of the sensor 150 is complete, e.g., the sensing switch 110 is closed.

The base station 120 can be configured to perform one or more functions based on the receipt or non-receipt of the heartbeat signal 210. For example, if the sensor 150 is employed in a security system as a proximity switch to indicate whether a door is open or shut, the base station 120 can indicate that the door is shut if the base station 120 receives the heartbeat signal 210, and can indicate, e.g., generate an alert, that the door is open if the base station 120 does not receive the heartbeat signal 210, e.g., for a specified period. The base station 120 and/or a computer device (not illustrated) connected to the base station 120 can have the necessary logic, components, circuitry and/or modules to interpret the meaning of a receipt or non-receipt of the heartbeat signal 210 and to perform the necessary functions based on the interpretation. In some embodiments, the interpretation and the performing of the necessary functions based on the interpretation may be distributed between the base station 120 and the computer device.

The sensing switch 110 described in FIGS. 1 and 2 is a normally open switch. However, in some embodiments, the sensing switch 110 is a normally closed switch, which opens when the magnetic field 205 is applied. In the normally closed sensing switch 110, the sensor 150 transmits the heartbeat signal 220 in the absence of the magnetic field 205 and ceases to transmit the heartbeat signal 210 in the presence of the magnetic field 205. That is, the behavior of the normally closed sensing switch 110 is opposite to that of the normally open sensing switch 110. The base station 120 may have to be configured accordingly to track the events appropriately. Continuing with the above example of the door, in the case of the normally closed sensing switch 110, the base station 120 may be configured to indicate that the door is shut if the base station 120 does not receive the heartbeat signal 210, e.g., for a specified period, and indicate that the door is open if the base station 120 receives the heartbeat signal 210.

In some embodiments, actuating the sensing switch 110 using the magnetic field 205 depends on various factors, e.g., strength of the magnetic field 205 and a sensing distance of the sensing switch 110.

Figure 3B:
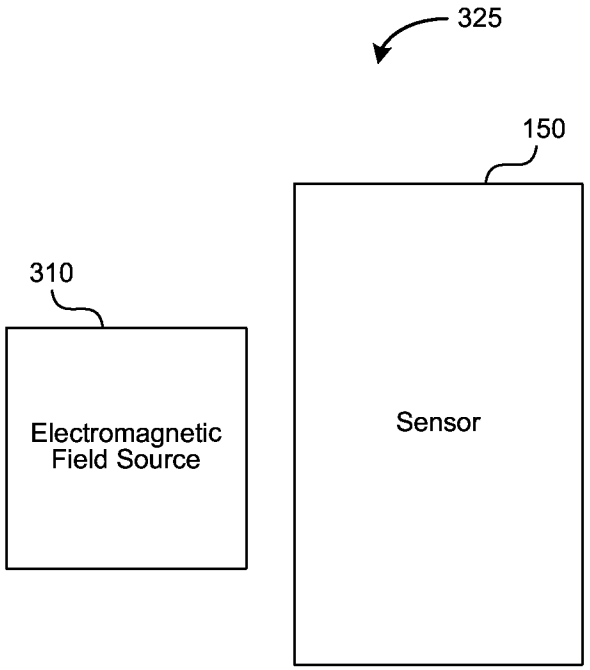
FIG. 3B is a block diagram illustrating an example of actuating the sensor of FIG. 1 using an electromagnetic field source.
Figure 3A:
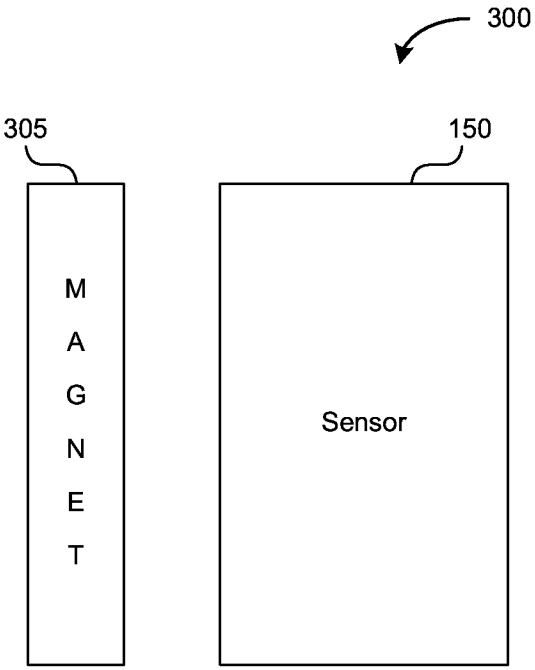
FIG. 3A is a block diagram illustrating an example of actuating the sensor of FIG. 1 using a permanent magnet.
Figure 3C:
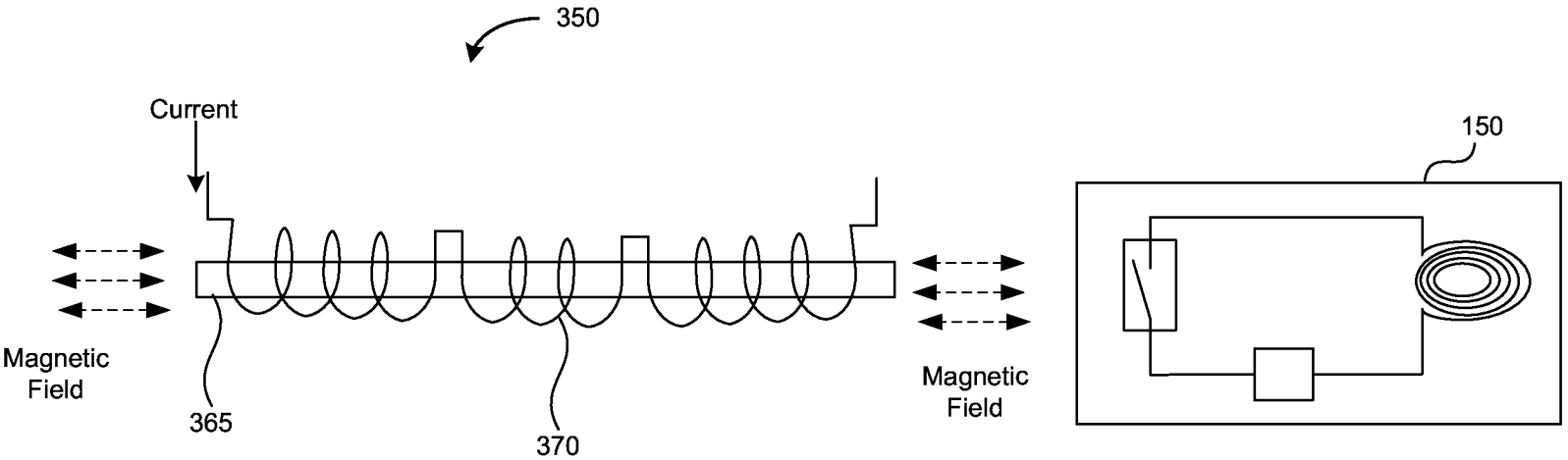
FIG. 3C is a block diagram illustrating an example of actuating the sensor of FIG. 1 using an electromagnetic coil.

FIGS. 3A-3C are block diagrams illustrating various ways of actuating the sensing switch of the sensor of FIG. 2, consistent with various embodiments. The sensing switch 110 can be actuated in a number of ways. FIG. 3A is a block diagram illustrating an example 300 of actuating the sensor of FIG. 1 using a permanent magnet 305. The sensing switch 110 can be actuated using a permanent magnet 305. The permanent magnet 305 can generate a magnetic field, e.g., magnetic field 205, that can be used to actuate the sensing switch 110. The permanent magnet 305 can be of any size and shape, which can be determined based on the intended application of the sensor 150. The permanent magnet 305 to be used, e.g., size, shape, strength, can also be determined based on factors including a strength of the magnetic field 205 required to actuate the sensing switch 110, the sensing distance of the sensing switch 110, a specification of the sensing switch 110, etc.

FIG. 3B is a block diagram illustrating an example 325 of actuating the sensor of FIG. 1 using an electromagnetic field source. The sensing switch 110 can be actuated using an electromagnet 310. In some embodiments, an electromagnet is a type of magnet in which a magnetic field, e.g., the magnetic field 205, is produced by an electric current. The magnetic field 205 disappears when the current is turned off. Electromagnets usually consist of a large number of closely spaced turns of wire that create the magnetic field in response to an application of current. One of the advantages of an electromagnet over a permanent magnet is that the magnetic field 205 can be quickly changed by controlling the amount of electric current flowing in the coil. Electromagnets are used as components of various electrical devices, e.g., motors, generators, relays, loudspeakers, hard disks, scientific instruments, and magnetic separation equipment. In some embodiments, the sensors 150 are used to detect presence or absence of such electromagnetic fields.

FIG. 3C is a block diagram illustrating an example of actuating the sensor of FIG. 1 using an electromagnetic coil 350. The electromagnetic coil 350 can produce an electromagnetic field, e.g., magnetic field 205, which can be used to actuate the sensing switch 110. In some embodiments, the electromagnetic coil 350 can be formed using a magnetic core 365, e.g., a ferromagnetic core, and a set of inductors 370 connected in series. When an electrical current flows through the set of the inductors 370, a magnetic field is generated in response to the current flow. This magnetic field can be used to actuate the sensing switch 110. In some embodiments, the magnetic field is generated in a direction perpendicular to the direction of flow of current in the set of inductors 370.

In some embodiments, the intensity of the magnetic field generated by the electromagnetic coil 350 can be controlled by the amount of electric current flowing through the electromagnetic coil 350.

Figure 3D:
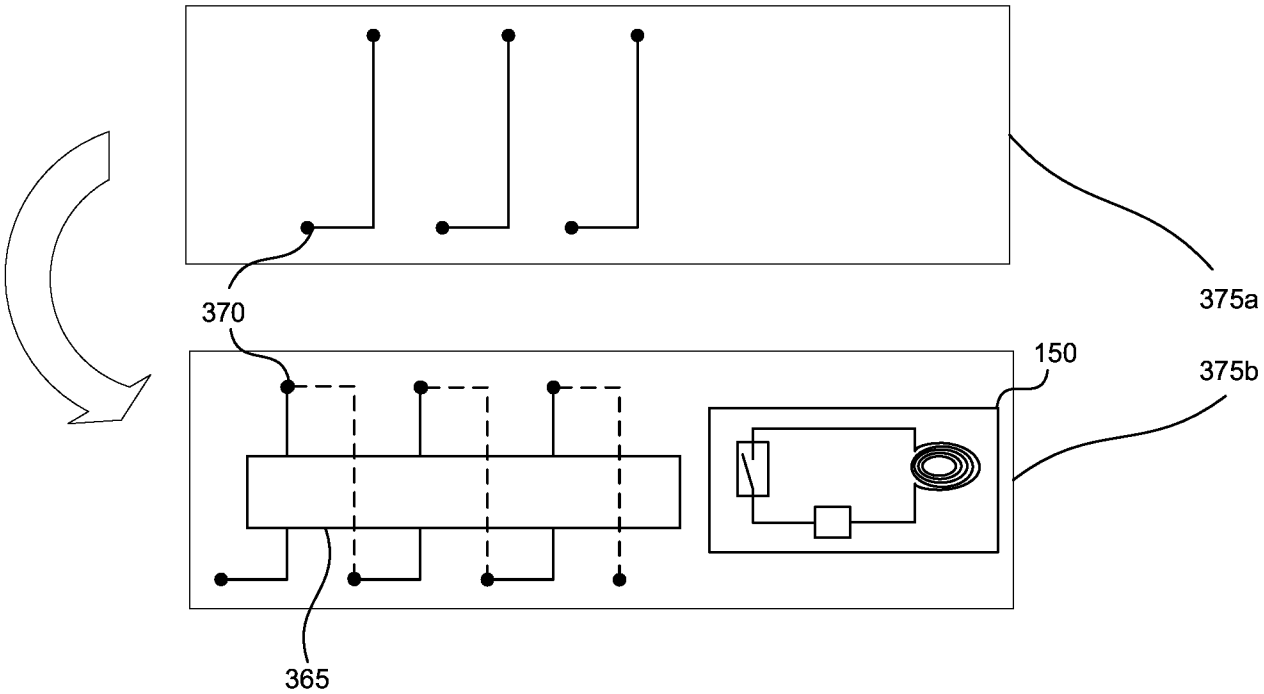
FIG. 3D is a block diagram illustrating an example construction of the sensor of FIG. 1 with the electromagnetic coil of FIG. 3C.

FIG. 3D is a block diagram illustrating an example construction of the sensor of FIG. 1 with the electromagnetic coil of FIG. 3C. The electromagnetic coil 350 and the sensor 150 can be built in various form factors. In some embodiments, the electromagnetic coil 350 and the sensor 150 are built into a sticker 375 (first sticker portion **375*a* and a second sticker portion 375*b* are collectively referred to as sticker 375). The set of inductors 370 are printed as wire traces in the sticker 375, and a metal plate or a core like material that acts as the magnetic core 365 can be affixed to one of the sticker portions. The wire traces form a coil when the first sticker portion 375*a* and the second sticker portion 375*b* are affixed to one another. The sticker 375 can be affixed to various surfaces, and can be used for a variety of applications. The sensor 150 can also printed onto one of the portions of the sticker 375**.

Figure 4A:
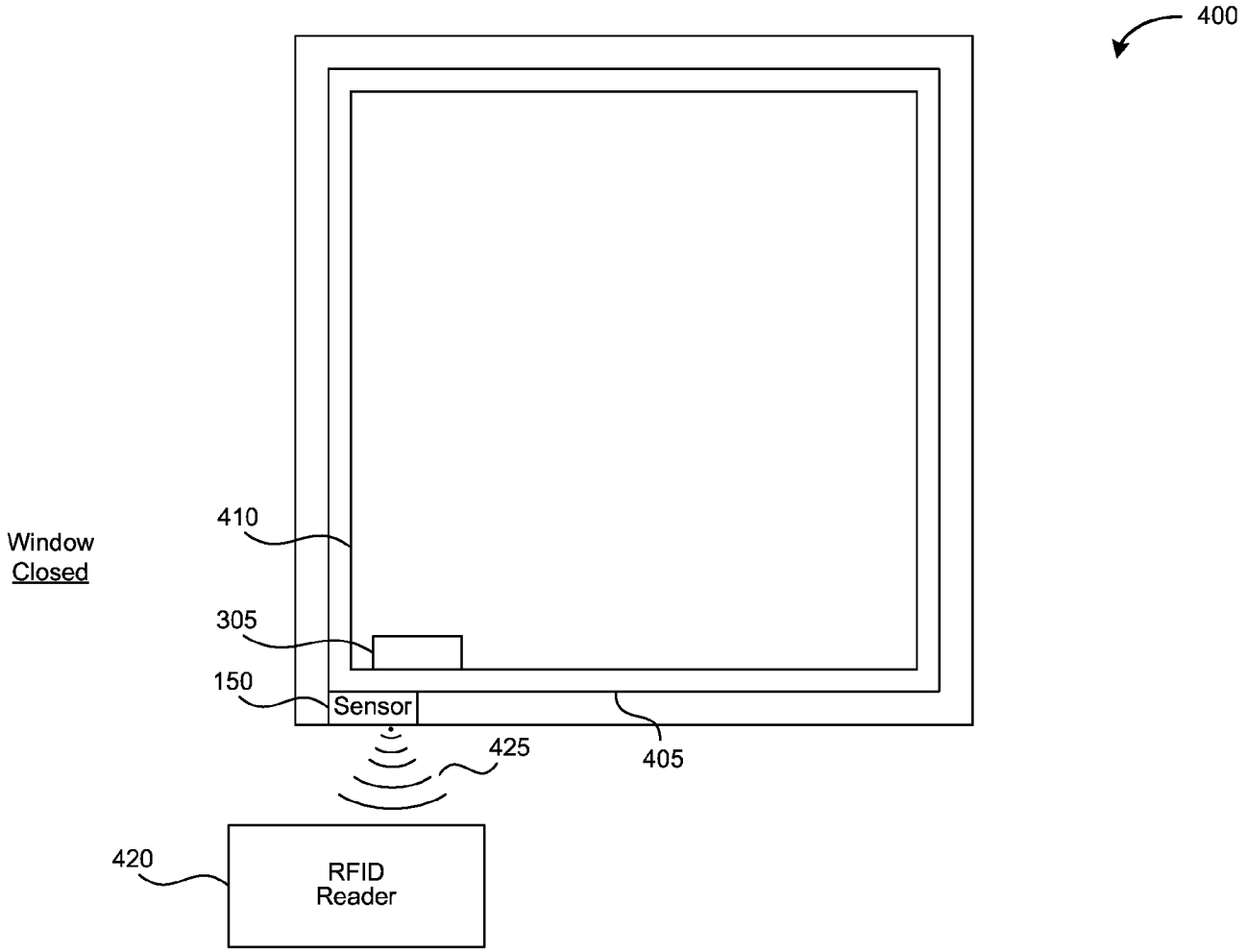
FIG. 4A is a block diagram of an example indicating a state of the sensor of FIG. 1 that is employed in a security system to determine whether a window is open or closed, when the window is closed.
Figure 4B:
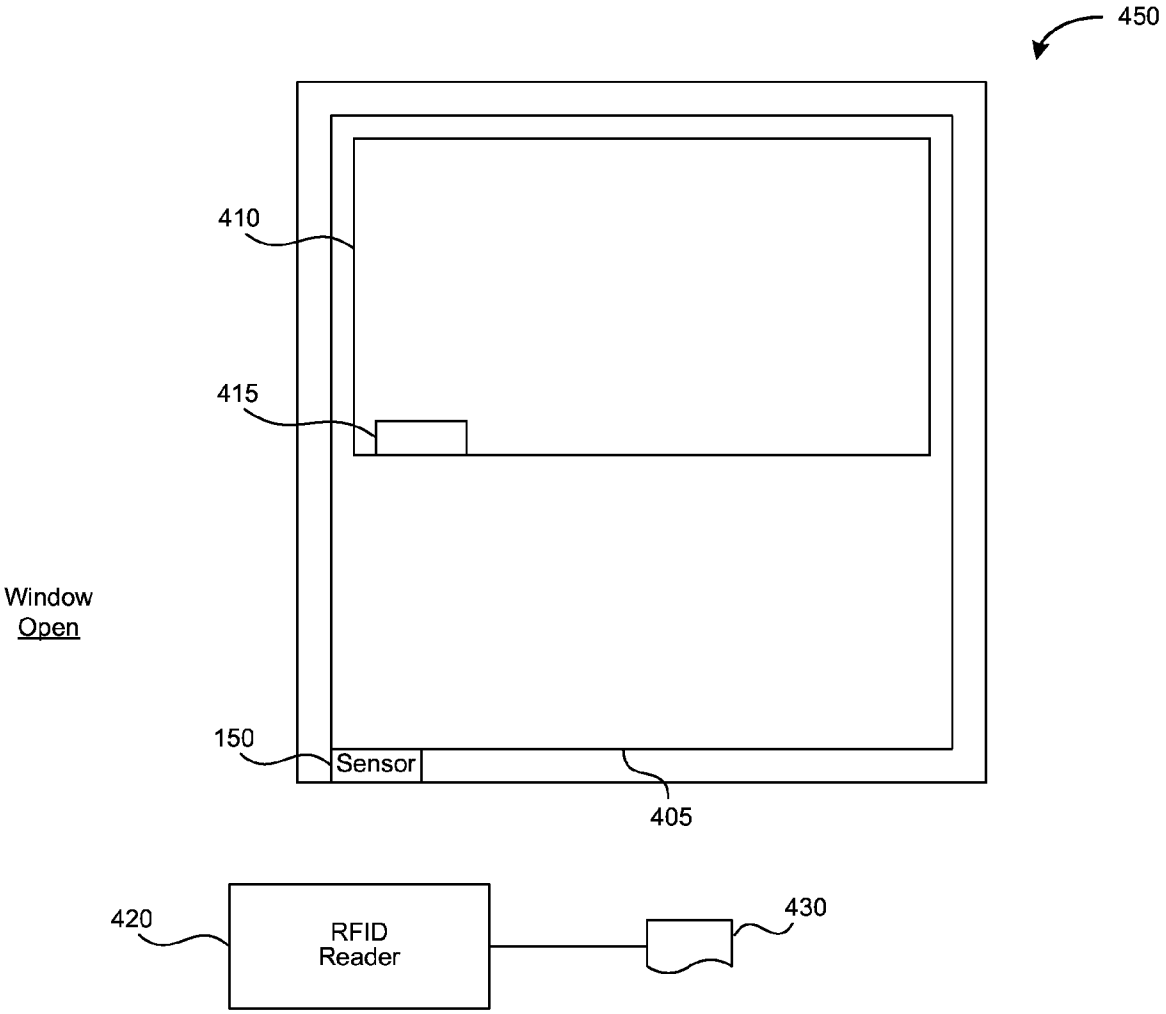
FIG. 4B is a block diagram of an example indicating a state of the sensor of FIG. 1, when the window is opened.

In some embodiments, an actuation method to be used can be determined based on an application for which the sensor 150 is used. FIGS. 4A, 4B and 5 illustrate examples of usage of the sensor of FIG. 1 in various applications.

FIGS. 4A and 4B are block diagrams illustrating the sensor of FIG. 1 employed in a security system as a proximity switch to indicate whether a window is open or closed. FIG. 4A is a block diagram of an example 400 indicating a state of the sensor, when the window is closed. In some embodiments, the sensor 150 is installed on a window sill or a frame 405. The sensor 150 can be built as a sticker, and affixed to the window frame 405. A magnetic source, e.g., permanent magnet 305, can be installed on a portion of the window, e.g., the door 410 of the window, that moves with respect to the window frame 405 when the window opens. The door 410 can be opened in any of various ways, e.g., the door 410 can be a vertically sliding door, a horizontally sliding door, rotates around a hinge, etc. The sensor 150 and the permanent magnet are installed accordingly. In some embodiments, the sensor 150 and the permanent magnet 305 are installed at appropriate locations of the window such that when the door 410 is shut, the magnetic field 205 generated by the permanent magnet 305 is in the proximity of the sensor 150, that is, the permanent magnet 305 is within the sensing distance of the sensor 150 (e.g., sensing switch 110 of the sensor 150), and when the door is opened, e.g., by a specified amount, the magnetic field 205 is not in the proximity of the sensor 150, that is, the permanent magnet 305 is beyond the sensing distance.

In some embodiments, the sensor 150 has a normally open sensing switch 110. When the door 410 is closed, the door 410 is near the window sill 405 such that the magnetic field 205 generated by the permanent magnet 305 is within the proximity of the sensor 150, causing the sensing switch 110 of the sensor 150 to be in the closed state. When the sensing switch 110 is in the closed state, the circuit of the sensor 150 is complete, thereby enabling the sensor 150 to respond to a probing request it receives from an RFID reader 420 by sending a heartbeat signal 425. In some embodiments, the RFID reader 420 is similar to the base station 120 of FIG. 1. Upon receiving the heartbeat signal 425, the RFID reader 420 can indicate that the window is closed. The indication can be provided in various ways. For example, the RFID reader 420 can be configured to provide an indication to an application ("app") installed on a computing device of a user that the window is closed. In another example, the RFID reader 420 can be configured to update the status of the window in a website to which the user may login to view the indication. In yet another example, the RFID reader 420 can be configured to provide the indication to a security agency, e.g., to a server computing device at the security agency via a computer network.

FIG. 4B is a block diagram of an example 450 indicating a state of the sensor of FIG. 1, when the window is opened. When the door 410 is opened, e.g., by a specified amount, such that the magnetic field 205 generated by the permanent magnet 305 is not in the proximity of the sensor 150 or does not have the strength required to close the sensing switch 110, the sensing switch 110 switches to an open state causing the circuit of the sensor 150 to be incomplete. Therefore, the sensor 150 is prevented from responding to the probe request of the RFID reader 420. When the RFID reader 420 does not receive the heartbeat signal 425 from the sensor 150, e.g., for a predefined period, the RFID reader 420 infers that the window is open and can indicate so. In some embodiments, the RFID reader 420 is configured to generate an alert 430, e.g., trigger an audio alarm at the premises where the window is installed, trigger a silent alarm at a security agency or a law enforcement agency, send a notification to a user via email or text message, and/or proved an indication to the app and/or the website.

In some embodiments, the sensor 150 may be installed on multiple windows, and the RFID reader can distinguish between the windows using the sensor data sent via the heartbeat signal 425. For example, the sensor data can include a unique identification number that identifies a specified sensor uniquely, and the RFID reader 420 can distinguish between different windows using the unique identification number of the sensors installed at the corresponding windows.

The sensor 150 can be used in various such security systems. In some embodiments, the sensor 150 does not have its own power source. The sensor 150 draws the power, e.g., required to generate and transmit the heartbeat signal 425, from the probing request received from the RFID reader 420. The RFID reader 420 and the sensor can communicate using various RF ranges, e.g., a low frequency range of 120-150 kHz, a high-frequency range of 13.56 MHz, an ultra-high frequency range of 433 MHz and 902-928 MHz. Different frequency ranges have different communication ranges, data speeds, and different costs. A particular frequency range can be chosen based on the application for which the sensor is used.

Figure 5A:
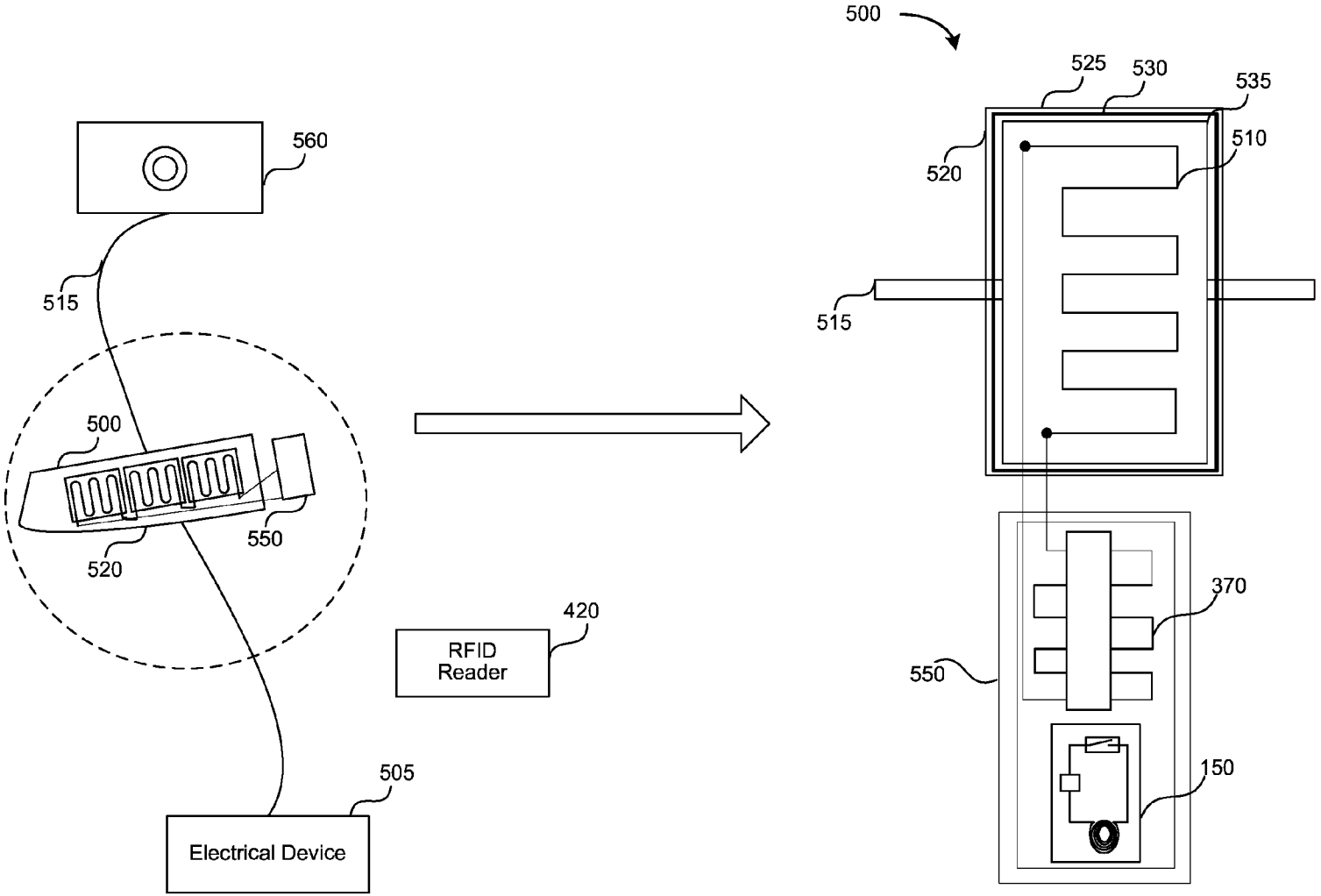
FIG. 5A is a block diagram of a power identification system in which the sensor of FIG. 1 is employed to determine whether an electrical device is powered on or off, consistent with various embodiments.

FIG. 5A is a block diagram of a power identification system 500 in which the sensor of FIG. 1 is employed, consistent with various embodiments. The power identification system 500 can employ the sensor 150 to determine whether an electrical device 505 is powered on or off. In some embodiments, the power identification system 500 employs the sensor 150 in which the sensing switch 110 is normally open.

In some embodiments, the power identification system 500 is built as a sticker. The power identification system 500 includes a first sticker portion 520 and a second sticker portion 550. The power identification system 500 can be wrapped around a power cord 515 of the electrical device 505 that is being monitored. The first sticker portion 520 includes a wire trace that forms a coil 510 when wrapped around the power cord 515. The second sticker portion 550 can be the sensor sticker 375, e.g., as illustrated in FIG. 3D. The electromagnetic coil 510 is connected to the electromagnetic coil 370 of the sensor sticker 375. The electromagnetic coils 510 and 370 can produce an electromagnetic field, e.g., magnetic field 205, which can be used to actuate the sensing switch 110.

The electrical device 505 can be powered using the power supply 560, which can supply either alternating current (AC) or direct current (DC). When the power supply 560 is switched on, current flows through the power cord 515 creating a magnetic field around the power cord 515, e.g., time-varying magnetic field in the interior of the coil 510, which generates a current in the coil 510. When the current flows from the coil 510 to coil 370, the current generates a magnetic field in the proximity of the coil 370. The magnetic field can be generated in a direction perpendicular to the direction of flow of current in the coil 370. In some embodiments, the magnetic field is amplified by the core 365 and is concentrated around the core 365. The magnetic field thus created causes the sensing switch 110 of the sensor 150 to switch to a closed state. Closing of the sensing switch 110 causes the circuit of the sensor 150 to be complete, thereby enabling the sensor 150 to respond to a probing request from the RFID reader 420 by sending a heartbeat signal, e.g., heartbeat signal 425.

Upon receiving the heartbeat signal 425, the RFID reader 420 can indicate that the electrical device is powered on. The indication can be provided in various ways. For example, the RFID reader 420 can be configured to provide an indication to the app installed on a computing device of a user that the electrical device 505 is powered on. In another example, the RFID reader 420 can be configured to update the status of the electrical device 505 in a website to which the user may login to view the indication. In yet another example, the RFID reader 420 is configured to generate an alert, e.g., send a notification to a user via email, text message or an app.

When the electrical device is powered off, the power stops flowing through the power cord 515 causing the magnetic field generated by the power cord 515 to cease, which stops the current flow in the coils 510 and 370 causing the magnetic field to cease, thereby causing the sensing switch 110 to switch to an open state. Opening of the sensing switch 110 causes the circuit of the sensor 150 to be incomplete, thereby preventing the sensor 150 from responding to a probing request from the RFID reader 420. When the RFID reader 420 does not receive the heartbeat signal 425 for a specified duration, it infers that the electrical device 505 is powered off and generates an indication indicating so. For example, the RFID reader 420 is configured to generate an alert, e.g., send a notification to a user via email, text message or an app.

In an event the power supplied from the power supply 560 is AC, the current generated in the coil 510, and therefore in the coil 370, can also be AC, which causes the magnetic field thus generated to vary repeatedly causing the sensing switch 110 to open and close repeatedly, e.g., at a frequency based on the frequency of the AC. The power identification system 500 can solve the problem caused due to such a situation using various methods, and can continue to provide accurate notifications. For example, the power identification system 500 can employ a diode that filters AC and outputs DC to the coil 370, thereby causing the magnetic field thus generated to be constant. In another example, the timeout period for receiving a heartbeat signal can be set such that that the RFID reader 420 infers that the electrical device 505 is powered on if the RFID reader 420 has received a predefined number of heartbeat signals within a specified period.

In the embodiment shown in FIG. 5A, the sensor 150 does not have its own power source. The sensor 150 (e.g., the RFID module 105) draws the power, e.g., required to generate and transmit the heartbeat signal 425, from the probing request received from the RFID reader 420.

Figure 5B:
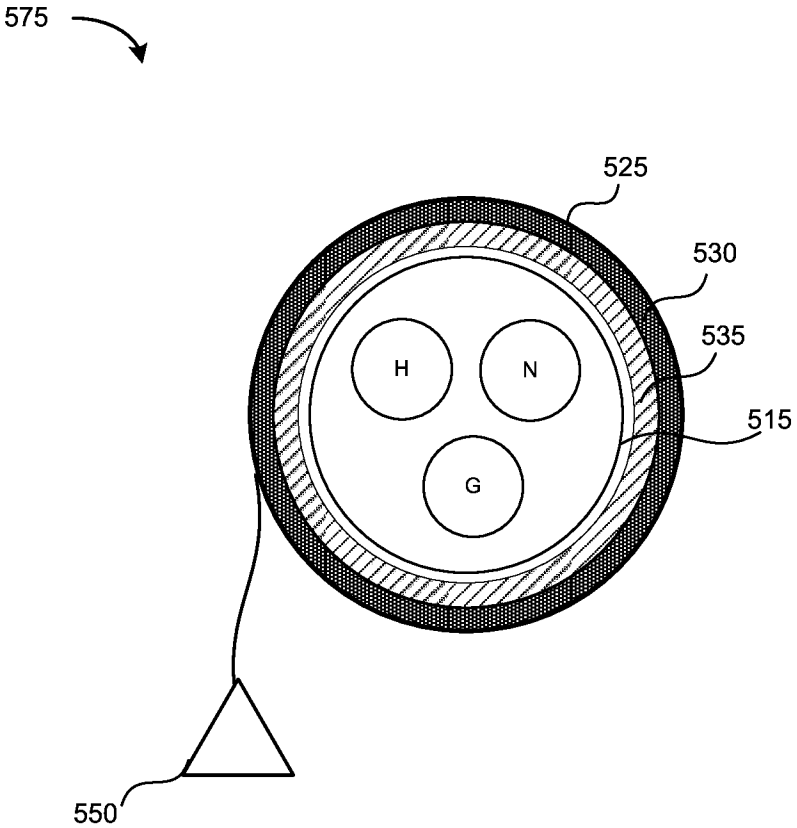
FIG. 5B is a block diagram of a cross section of a power cord wrapped with the power identification system of FIG. 5A, consistent with various embodiments.

The first sticker portion 520 can built as a multilayered sticker. FIG. 5B is a block diagram of a cross section 575 of the power cord 515 wrapped with the power identification system 500, consistent with various embodiments. As illustrated in the cross section 575, the first layer 535, which includes the wire trace that forms the coil 510, is the most proximate layer to the power cord 515, when the power identification system 500 is wrapped around the power cord 515. The second layer 530, which is above the first layer 535 and farther from the power cord 515, includes a flexible metal that acts like a magnetic core to strengthen the magnetic field generated in response to a current flowing through the coil 510. In some embodiments, the flexible metal layer is used to supplement the strength of the magnetic field generated by the coil 370 of the second sticker portion 550. The third layer 525, which is the farthest layer from the power cord 515, can be any material, e.g., paper, that can be used to conceal the flexible metal. The "H", "N" and "G" in the power cord 515 indicate the hot, neutral and ground wires of the power cord 515.

Figure 6:
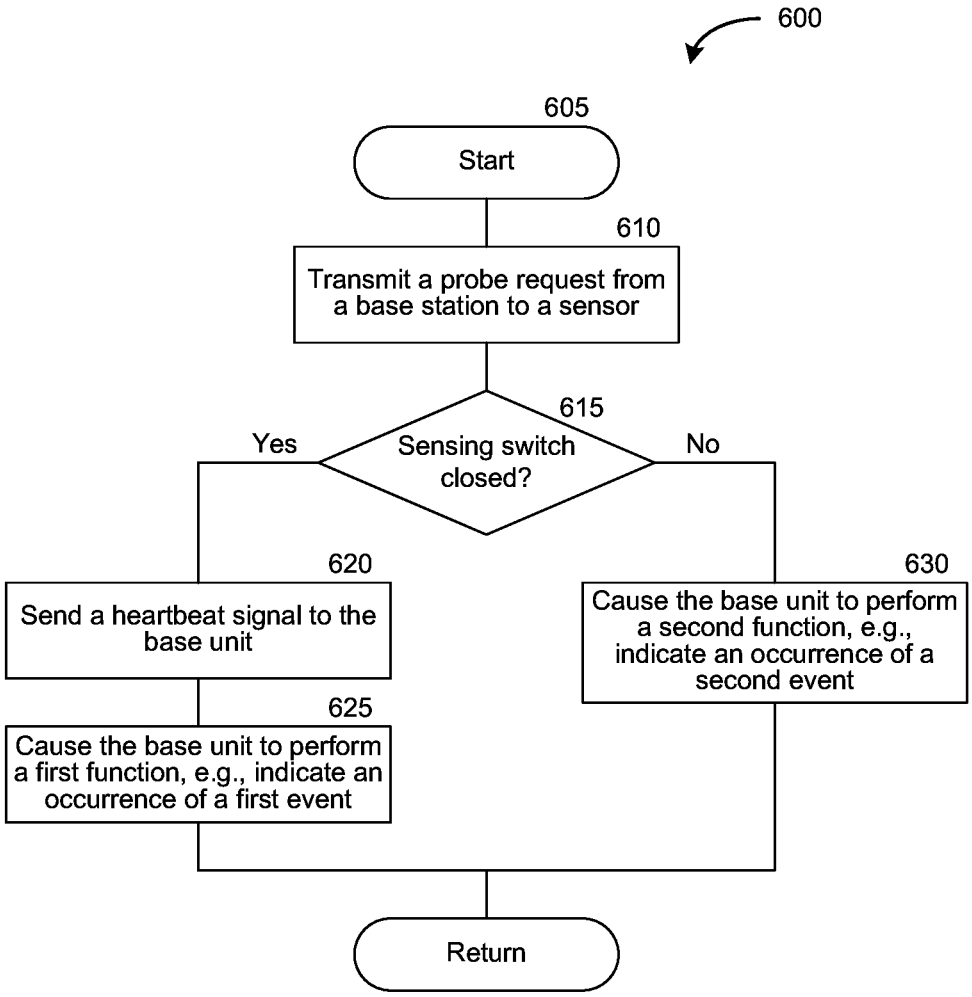
FIG. 6 is a flow diagram of a process for using a sensor of FIG. 1 for tracking or monitoring events in various types of applications, consistent with various embodiments.

FIG. 6 is a flow diagram of a process 600 for using a sensor of FIG. 1 for tracking or monitoring events in various types of applications, consistent with various embodiments. In some embodiments, the process 600 can be implemented using the sensor system 100 of FIG. 1. The process 600 begins at block 605, and at block 610, the base station 120 transmits a probe request signal to the sensor 150. In some embodiments, the probe request signal is an encoded RF signal that requests a sensor to respond by sending a response, e.g., heartbeat signal. The heartbeat signal typically serves as a signal to indicate that a sensor is active and/or online. The heartbeat signal can also include sensor data, e.g., information regarding an object with which the sensor 150 is used, a unique serial number of the sensor 150 and/or the object, a product-related information such as a stock number, a lot or batch number, a production date associated with the object.

At determination block 615, it is determined if the sensing switch 110 of the sensor 150 is closed. If the sensing switch 110 is closed, at block 620, the sensor 150 transmits a heartbeat signal, e.g., heartbeat signal 210 of FIG. 2, to the base station 120. In some embodiments, the sensor 150 is a passive sensor, that is, the sensor 150 may not have its own power source and transmits the heartbeat signal only in response to a probe request from the base station 120.

Upon receiving the heartbeat signal, at block 625, the base station 120 performs a first function, e.g., indicate the occurrence of a first event indicative of the sensing switch being closed.

Referring back to the determination block 615, if the sensing switch 110 is not closed, the sensor 150 is not active, e.g., the sensor 150 cannot receive the probe request from the base station 120, and therefore, does not transmit the heartbeat signal to the base station 120. Upon failure to receive the heartbeat signal for a predefined period, at block 630, the base station 120 performs a second function, e.g., indicate the occurrence of a second event associated with the non-receipt of the heartbeat signal.

In some embodiments, the first and second events and the first and second functions performed by the base station depends on the application in which the sensor 150 is employed. For example, if the sensor 150 is employed as a proximity switch in a security system to indicate whether a door is open or shut, and the sensor includes a sensing switch that is normally open, the first event could be an event indicating the door is shut and the second event could be an event indicating the door is open. The first function can be a function for indicating that the door is shut, in an app installed on a computing device of a user. The second function can be a function for generating an alert, e.g., sending an email or a text message to the user or triggering a silent alarm at a law enforcement agency, to indicate that the door is open.

Further, if the sensing switch 110 is a normally closed type, the first function and the second function and the first and second events could be a reverse of what is described above.

The base station 120 and/or a computer device (not illustrated) connected to the base station 120 can have the necessary logic, components, circuitry and/or modules to interpret the meaning of a receipt or non-receipt of the heartbeat signal 210, and to perform the necessary functions based on the interpretation.

Figure 7:
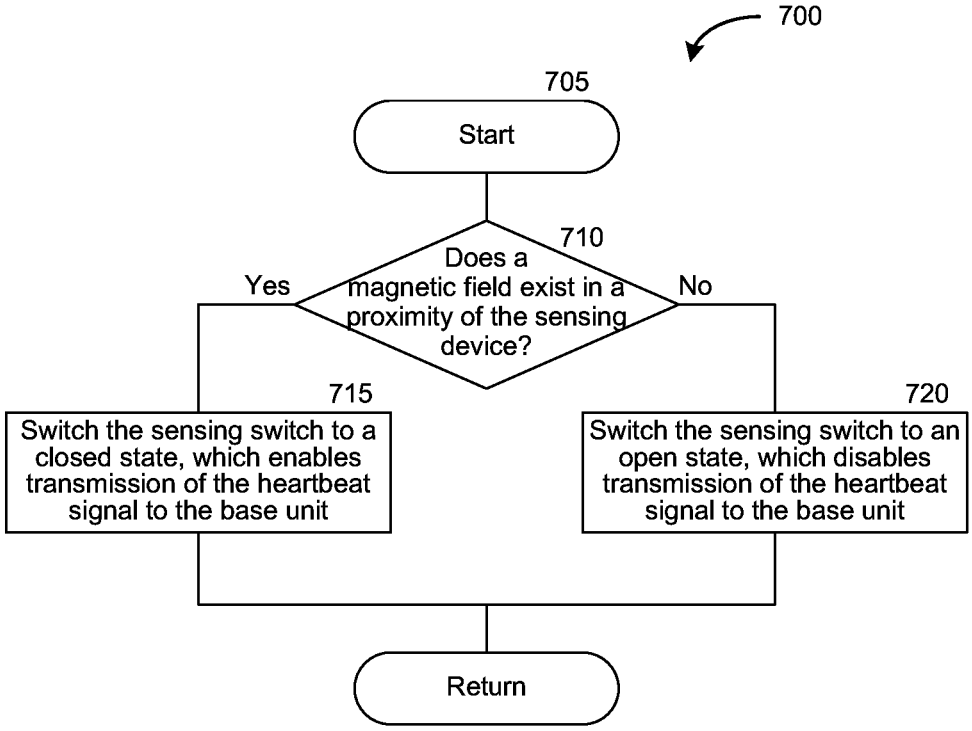
FIG. 7 is a flow diagram of a process for actuating a sensing switch of a sensor of FIG. 1 using a magnetic field, consistent with various embodiments.

FIG. 7 is a flow diagram of a process 700 for actuating a sensing switch of a sensor of FIG. 1 using a magnetic field, consistent with various embodiments. In some embodiments, the process 700 can be implemented using the sensor system 100 of FIG. 1. The process 700 is described with reference to a sensor having a sensing switch that is normally open. However, the process 700 is not restricted to a sensor having a sensing switch that is normally open and can be implemented for a sensor having a sensing switch that is normally closed. The process 700 begins at block 705, and at block 710, it is determined if a magnetic field, e.g., magnetic field 205, exists in the proximity of the sensing switch 110. If the magnetic field exists, at block 715, the sensing switch 110 switches to a closed state, which completes the circuit of the sensor 150, thereby enabling the sensor 150 to transmit the heartbeat signal 210 to the base station 120 in response to a probe request from the base station 120, e.g., as described at least with reference to FIG. 6.

If the magnetic field does not exist or is not strong enough to close the switch 110 in the proximity of the sensor 150, at block 720, the sensing switch 110 switches remains in an open state, which causes the circuit of the sensor 150 to be incomplete, thereby preventing the sensor 150 from transmitting the heartbeat signal 210 and receiving the probe request from the base station 120, e.g., as described at least with reference to FIG. 6.

In some embodiments, the magnetic field can be generated using a permanent magnet and/or an electromagnet. In some embodiments, the magnetic field is determined to be in the proximity of the sensor if the strength of the magnetic field near the sensing switch 110 is strong enough to cause the sensing switch to change state. In some embodiments, the magnetic field is determined to be in the proximity of the sensor if the magnet that generates the magnetic field is within the sensing distance of the sensor (e.g., sensing switch 110 of the sensor 150).

Figure 8:
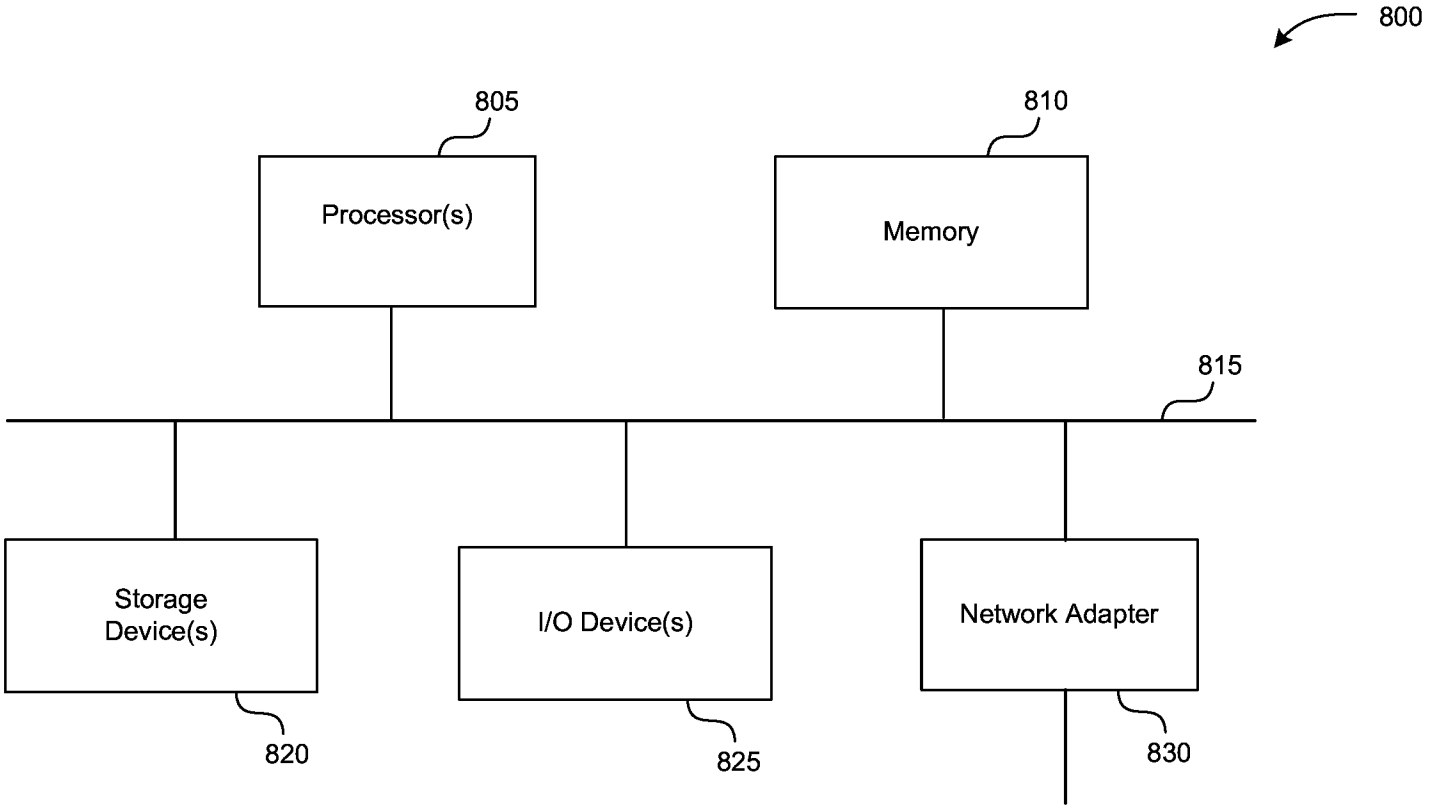
FIG. 8 is a block diagram of a processing system that can implement operations of the disclosed embodiments.

FIG. 8 is a block diagram of a computer system as may be used to implement features of the disclosed embodiments. The computing system 800 may be used to implement any of the entities, components or services depicted in the examples of the foregoing figures (and any other components and/or modules described in this specification). The computing system 800 may include one or more central processing units ("processors") 805, memory 810, input/output devices 825 (e.g., keyboard and pointing devices, display devices), storage devices 820 (e.g., disk drives), and network adapters 830 (e.g., network interfaces) that are connected to an interconnect 815. The interconnect 815 is illustrated as an abstraction that represents any one or more separate physical buses, point to point connections, or both connected by appropriate bridges, adapters, or controllers. The interconnect 815, therefore, may include, for example, a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus, also called "Firewire".

The memory 810 and storage devices 820 are computer-readable storage media that may store instructions that implement at least portions of the described embodiments. In addition, the data structures and message structures may be stored or transmitted via a data transmission medium, such as a signal on a communications link. Various communications links may be used, such as the Internet, a local area network, a wide area network, or a point-to-point dial-up connection. Thus, computer readable media can include computer-readable storage media (e.g., "non-transitory" media) and computer-readable transmission media.

The instructions stored in memory 810 can be implemented as software and/or firmware to program the processor(s) 805 to carry out actions described above. In some embodiments, such software or firmware may be initially provided to the processing system 800 by downloading it from a remote system through the computing system 800 (e.g., via network adapter 830).

The embodiments introduced herein can be implemented by, for example, programmable circuitry (e.g., one or more microprocessors) programmed with software and/or firmware, or entirely in special-purpose hardwired (non-programmable) circuitry, or in a combination of such forms. Special-purpose hardwired circuitry may be in the form of, for example, one or more ASICs, PLDs, FPGAs, etc.

An RFID programmer can program the above described sensor 150, e.g., RFID module 105 in the sensor, using the I/O device 825. For example, the programmer can use the I/O device 825 to store the sensor data in the RFID module 105.

Remarks

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments. Accordingly, the embodiments are not limited except as by the appended claims.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Terms that are used to describe the disclosure are discussed below, or elsewhere in the specification, to provide additional guidance to the practitioner regarding the description of the disclosure. For convenience, some terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be said in more than one way. One will recognize that "memory" is one form of a "storage" and that the terms may on occasion be used interchangeably.

Consequently, alternative language and synonyms may be used for any one or more of the terms discussed herein, nor is any special significance to be placed upon whether or not a term is elaborated or discussed herein. Synonyms for some terms are provided. A recital of one or more synonyms does not exclude the use of other synonyms. The use of examples anywhere in this specification including examples of any term discussed herein is illustrative only, and is not intended to further limit the scope and meaning of the disclosure or of any exemplified term. Likewise, the disclosure is not limited to various embodiments given in this specification.

Those skilled in the art will appreciate that the logic illustrated in each of the flow diagrams discussed above, may be altered in various ways. For example, the order of the logic may be rearranged, substeps may be performed in parallel, illustrated logic may be omitted; other logic may be included, etc.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions will control.

I claim:

1. An apparatus, comprising:

a first module configured to generate a heartbeat signal to be transmitted to a base station using a radio-frequency (RF) signal, wherein the first module is configured to obtain power for generating the heartbeat signal from a request signal received from the base station;

an antenna configured to transmit the heartbeat signal to the base station using the RF signal;

a sensing switch configured to enable or disable transmission of the heartbeat signal to the base station based on a magnetic field in a proximity of the sensing switch, wherein the sensing switch enables the transmission of the heartbeat signal in a presence of the magnetic field, and wherein the sensing switch disables the transmission of the heartbeat signal in an absence of the magnetic field; and an electromagnetic source that is configured to generate the magnetic field, wherein the electromagnetic source includes a set of inductors printed onto a sticker that is configured to be wrapped around an electrical conductor to generate the magnetic field to operate the sensing switch, the sensing switch included in the sticker.

2. The apparatus of claim 1, wherein the base station is configured to:

receive the heartbeat signal transmitted from the antenna, and generate an alert in an event a time elapsed since a last heartbeat signal is received exceeds a specified threshold.

3. The apparatus of claim 1, wherein the sensing switch is configured to respond to the magnetic field generated by an electromagnetic source.

4. The apparatus of claim 1 further comprising:

a permanent magnet that generates the magnetic field.

5. The apparatus of claim 1, wherein the sensing switch is configured to respond to the magnetic field generated by a permanent magnet.

6. The apparatus of claim 1, wherein the sensing switch is configured to be used in a security system for detecting whether a door is opened or closed.

7. The apparatus of claim 6, wherein, when the door is opened, the sensing switch is configured to detect the absence of the magnetic field, which is generated by a magnetic source installed on the door, and disable the transmission of the heart beat signal to the base station, and wherein the base station is configured to generate an alert to be transmitted to a client device indicating that the door is opened in response to non-receipt of the heartbeat signal.

8. A method, comprising:

receiving, at a sensor, a request from a base station for a heartbeat signal;

determining, by a sensing switch of a sensor, whether a magnetic field exists in a proximity of the sensor, wherein determining whether the magnetic field exists includes generating the magnetic field using an electromagnetic source associated with the sensor, the electromagnetic source including a set of inductors printed onto a sticker that is configured to be wrapped around an electrical conductor, the sticker configured to generate the magnetic field to operate the sensing switch when an electrical current flows through the electrical conductor;

switching the sensing switch to a first state in an event the magnetic field is present in the proximity of the sensor;

switching the sensing switch to a second state in an event the magnetic field is absent in the proximity of the sensor; and causing the base station to generate an alert indicating an occurrence of an event the sensor is configured to track, based on whether or not the heartbeat signal is transmitted from the sensor, wherein the transmission of the heartbeat signal is dependent on a state of the sensing switch, wherein the heartbeat signal is generated using power obtained from a signal of the request from the base station.

9. The method of claim 8, wherein the first state of the sensing switch enables transmission of the heartbeat signal to the base station and the second state disables transmission of the heartbeat signal to the base station.

10. The method of claim 8, wherein the first state of the sensing switch disables transmission of the heartbeat signal to the base station and the second state enables transmission of the heartbeat signal to the base station.

11. The method of claim 8, wherein causing the base station to generate the alert includes generating the alert in an event the heartbeat signal is not received from the sensor for a specified duration.

12. The method of claim 8, wherein causing the base station to generate the alert includes generating the alert in an event the heartbeat signal is received from the sensor.

13. The method of claim 8 further comprising:

determining whether there is a flow of current in a power chord of an electrical device as the event, using the electromagnetic source placed in proximity to the power cord, the electromagnetic source generating the magnetic field when there is a flow of current in the power cord, switching the sensing switch to the second state in an event there is no flow of current in the power cord, and causing the base station to generate, in response to not receiving the heartbeat signal from the sensor, the alert indicating that the electrical device is powered off.

14. The method of claim 8, wherein determining whether the magnetic field exists includes generating the magnetic field using a permanent magnet associated with the sensor.

15. A method, comprising:

detecting, by a sensing switch of a sensor, a magnetic field generated by an electromagnetic source installed at an object, wherein the sensing switch is caused to switch to one of a closed state or an open state by the magnetic field, wherein the electromagnetic source includes a set of inductors printed onto a sticker that is configured to be wrapped around a power cord of the object, the sticker configured to generate the magnetic field to operate the sensing switch when an electrical current flows through the object;

setting the sensing switch to an open state in response to the detecting, the open state of the sensing switch disabling a transmission of a heartbeat signal from the sensor to a base station that is tracking an event associated with the object, wherein the heartbeat signal is generated using power obtained from a request signal received from the base station; and causing the base station to generate an alert indicating that the object is powered off in an event the base unit does not receive the heartbeat signal for a specified duration.

16. The method of claim 15 further comprising:

detecting, by the sensing switch, a presence of the magnetic field in the proximity of the sensor;

setting the sensing switch to a closed state, the closed state of the sensing switch enabling a transmission of the heartbeat signal from the sensor to the base station; and transmitting, by the sensor, the heartbeat signal as a RF signal to the base station.

* * * * *